US009726396B2

(12) United States Patent
Sjogren

(10) Patent No.: US 9,726,396 B2
(45) Date of Patent: Aug. 8, 2017

(54) UNIVERSAL LINE COMPONENTS DUCT ELBOW

(71) Applicant: Diversitech Corporation, Conyers, GA (US)

(72) Inventor: Richard Sjogren, Milton, GA (US)

(73) Assignee: Diversitech Corporation, Conyers, GA (US)

( * ) Notice: Subject to any disclaimer, the term of this patent is extended or adjusted under 35 U.S.C. 154(b) by 0 days.

(21) Appl. No.: 15/040,043

(22) Filed: Feb. 10, 2016

(65) Prior Publication Data

US 2016/0334155 A1 Nov. 17, 2016

Related U.S. Application Data

(60) Provisional application No. 62/162,110, filed on May 15, 2015.

(51) Int. Cl.

| | |
|---|---|
| ***F24F 13/22*** | (2006.01) |
| ***F24F 13/20*** | (2006.01) |
| ***F28B 9/08*** | (2006.01) |

(52) U.S. Cl.

CPC ..... *F24F 13/20* (2013.01); *F24F 13/22* (2013.01); *F24F 13/222* (2013.01); *F28B 9/08* (2013.01)

(58) Field of Classification Search

USPC ..... 174/68.1

See application file for complete search history.

(56) References Cited

U.S. PATENT DOCUMENTS 4,951,716 A * 8/1990 Tsunoda ..... H02G 3/0418 138/157

* cited by examiner

*Primary Examiner* — Dhirubhai R Patel

(74) *Attorney, Agent, or Firm* — Smith Gambrell & Russell LLP

(57) ABSTRACT

A universal line components duct elbow (universal elbow) accommodates a variety of condensate tanks. The universal elbow includes an elbow base, an elbow cover, and an interface clip. The interface clip is releasably connected to the bottom wall and sidewalls of the elbow base and adapted for supporting a condensate tank within the universal elbow. In order to releasably connect the interface clip to the bottom wall of the elbow base, the bottom wall of the elbow base includes an elbow base/clip securing structure that engages a complementary clip/elbow base securing structure on one side of the interface clip. In order to secure the condensate tank within the universal elbow, the interface clip has a clip/tank securing structure on the opposite side that engages the structure of the condensate tank.

10 Claims, 13 Drawing Sheets

Annotated Drawings

UNIVERSAL LINE COMPONENTS DUCT ELBOW

CROSS REFERENCE TO RELATED PATENT APPLICATIONS

This invention claims priority from U.S. Provisional Patent Application No. 62/162,110, filed May 15, 2015, which is hereby incorporated by reference.

FIELD OF THE INVENTION

This invention relates to a line components duct system for enclosing refrigeration lines, electrical wires, and condensate tubes for a heating and cooling air conditioning system, and more particularly relates to a universal line components duct elbow for enclosing the line components and variety of condensate tanks.

BACKGROUND OF THE INVENTION

In a heating and cooling air conditioning system, such as a ductless mini split heating and cooling air conditioning system, refrigeration lines and electrical wires run between an evaporator unit located inside a building and a condenser unit located outside the building. The heating and cooling air conditioning system may also include condensate tubes that run from the evaporator to a condensate tank, from the condensate tank to a condensate pump, and from the condensate pump to a drain inside the building or to a location outside the building. The refrigeration lines, condensate tubes, and electrical wires will be collectively referred to hereinafter as line components. In order to keep the line components organized and out of sight, an enclosed line components duct system or trunk houses the line components. The line components duct system is used inside the building to enclose the line components between the evaporator and a point of penetration to the outside of the building in the circumstances where the line components cannot be embedded in a wall such as is the case with older plaster construction. In addition, the line components duct system is used outside the building between the wall penetration point from the interior of the building and the condenser unit. The line components duct system is particularly useful when a building is retrofit with the ductless mini split heating and cooling air conditioning system with the evaporator unit attached to a wall adjacent the ceiling of a room within the building. In such a case, the line components duct system typically runs from the mini split evaporator unit mounted on the interior wall to the ceiling along the interior wall.

DiversiTech Corporation, the assignee of the present invention and application, sells a line components duct system under the mark SpeediChannel. Such a line components duct system includes a straight section line components duct having a rectangular cross-section. The straight section line components duct comprises an elongated base with an attached side wall and a snap on cover with an attached side wall. The cover with its attached side wall snaps onto the base with its attached side wall to complete the enclosure of the straight section line components duct. An integral channel with a series of channel clips runs along the length of the elongated base. The channel clips engage the integral channel and are slidable along the length of the integral channel. The channel clips secure the line components to the base of the line components duct in order to keep the line components from shifting or vibrating. The line components duct system also includes various fittings to accommodate turns in the direction of the line components, to accommodate penetration of the internal and external walls of the building, and to accommodate attachment of the line components duct to the condenser unit and the evaporator unit.

In a typical installation for a ductless mini split heating and cooling air conditioning system, the base of the line components duct is attached to a mounting surface such as the internal wall of the room of the building. The line components are positioned on the base and secured with the channel clips. The cover with its attached wall is then snapped onto the base with its attached wall to complete the enclosure, to protect the line components, and to hide the line components from view.

In installations of the mini split heating and cooling air conditioning system, a condensate tank is required to collect condensate produced by the evaporator unit. A condensate pump is then mounted at a remote location to draw the condensate from the condensate tank and pump the condensate to either a drain inside the building or to a remote location outside the building. The condensate tank is typically located closely adjacent the evaporator unit. In that regard, the condensate tank is often located in a line components duct elbow where the condensate line and the rest of the line components exit the evaporator unit and then make a 90° turn toward the ceiling of the room. The condensate pump is usually located above the ceiling and draws the condensate from the condensate tank through the condensate tube in the line components duct.

A number of manufacturers offer a condensate tank and associated condensate pump. The condensate tanks are offered in a variety of sizes and shapes. Consequently, an installer must stock a variety of line components duct elbows in order to accommodate the variety of sizes and shapes of the various condensate tanks.

SUMMARY OF THE INVENTION

The present invention addresses the problem associated with the need of the installer to stock a variety of line components duct elbows by providing a universal line components duct elbow (universal elbow) that will accommodate a variety of condensate tanks. Particularly, the universal elbow includes an elbow base, with a bottom wall and sidewalls, an elbow cover, and an interface clip releasably connected to the bottom wall and the sidewall of the elbow base and adapted for supporting a condensate tank within the universal elbow. In order to releasably connect the interface clip to the bottom wall and the sidewall of the elbow base, the bottom wall and sidewall of the elbow base include an elbow base/clip securing structure that engages a complementary clip/elbow base securing structure on one side of the interface clip. In order to secure the condensate tank within the universal elbow, the interface clip has a clip/tank securing structure on the opposite side of the interface clip that engages the unique structure of each of the condensate tanks that are available.

In order to accommodate a variety of differently shaped condensate tanks, the installer only needs to stock a variety of smaller interface clips that are connected to the bottom wall and the sidewall of the elbow base and which have a variety of different clip/tank securing structures each of which is specifically configured to match the size and structure of a particular commercially available condensate tank.

Further objects, features and advantages will become apparent upon consideration of the following detailed description of the invention when taken in conjunction with the drawings and the appended claims.

DETAILED DESCRIPTION OF THE PREFERRED EMBODIMENTS

Figure 1:
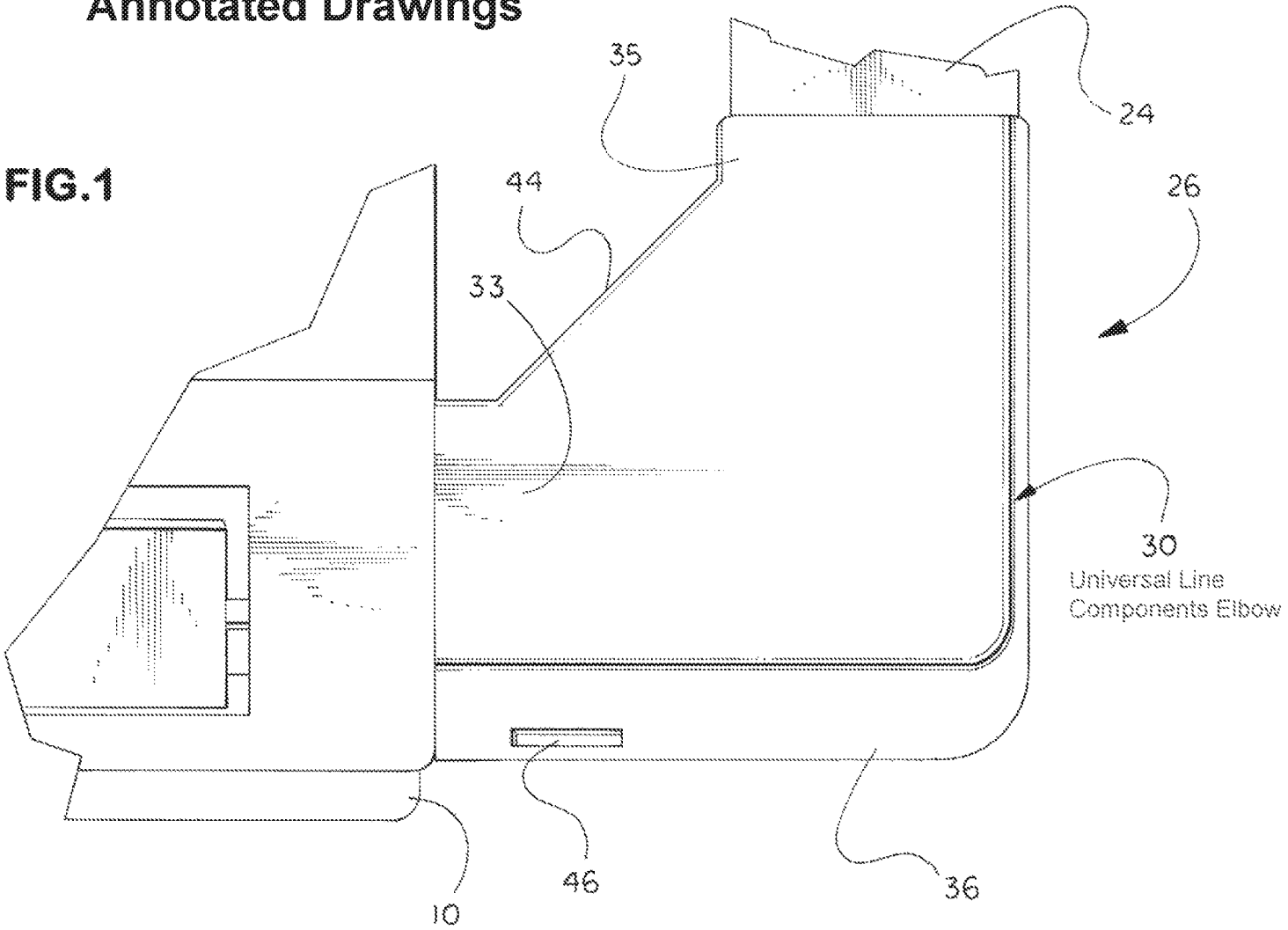
FIG. 1 is a side perspective view of a universal line components duct elbow (universal elbow) in accordance with the present invention and with the universal elbow attached at one end to an evaporator unit and at the other end to a straight section line components duct.
Figure 2:
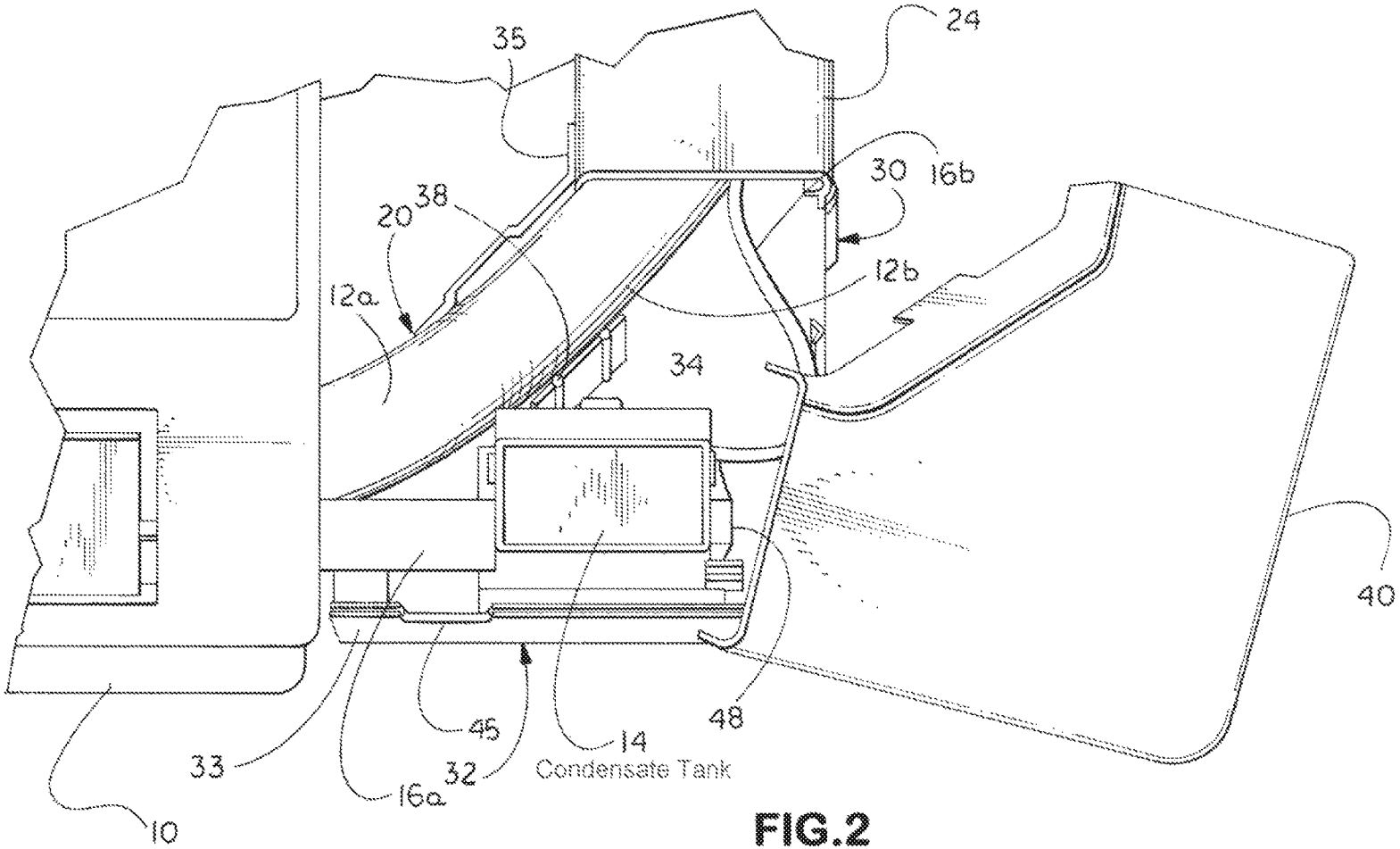
FIG. 2 is a side perspective view of the universal elbow of FIG. 1 with the cover removed to reveal line components and a condensate tank.
Figure 3:
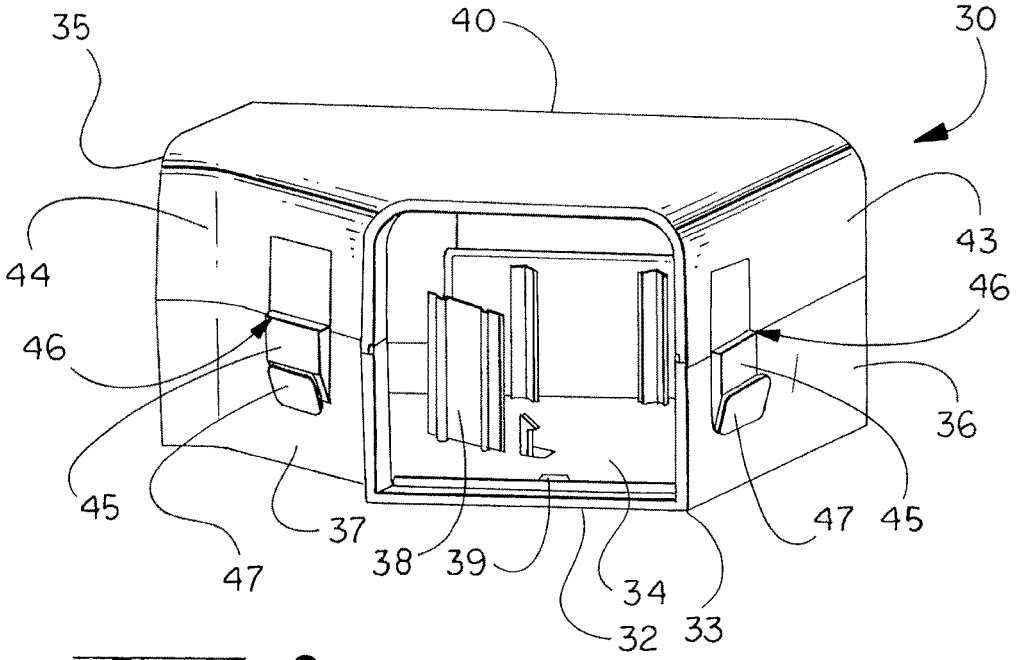
FIG. 3 is a side perspective view of the universal elbow in accordance with the present invention.

Turning to FIGS. 1 and 2, a universal line components elbow (universal elbow) 30 is attached at a first end 33 to an evaporator unit 10 and attached at a second end 35 to a straight section line components duct 24. The evaporator unit 10, the universal elbow 30, and the straight section line components duct 24 are attached by standard means to an interior wall 26 of a room of a building. As shown in FIG. 2, the universal elbow 30 includes an elbow cover 40 and an elbow base 32. The elbow cover 40 is removably attached to the elbow base 32 by means of latches 46 (FIG. 3). In FIG. 2, the elbow cover 40 is removed to show the space inside the elbow base 32. Particularly, the universal elbow 30 houses line components 20 including insulated refrigeration lines 12*a* and 12*b*, electric wiring 16*b*, condensate tubes 16*a*. A condensate tank 14 is also located inside the universal elbow 30. The condensate tank 14 is connected to bottom wall 34 and to sidewall 36 of the elbow base 32 by means of an interface clip 48, which is one of several interface clips 48, 148, 248, 348, 448, and 548 and which will be described in greater detail below.

Figure 4:
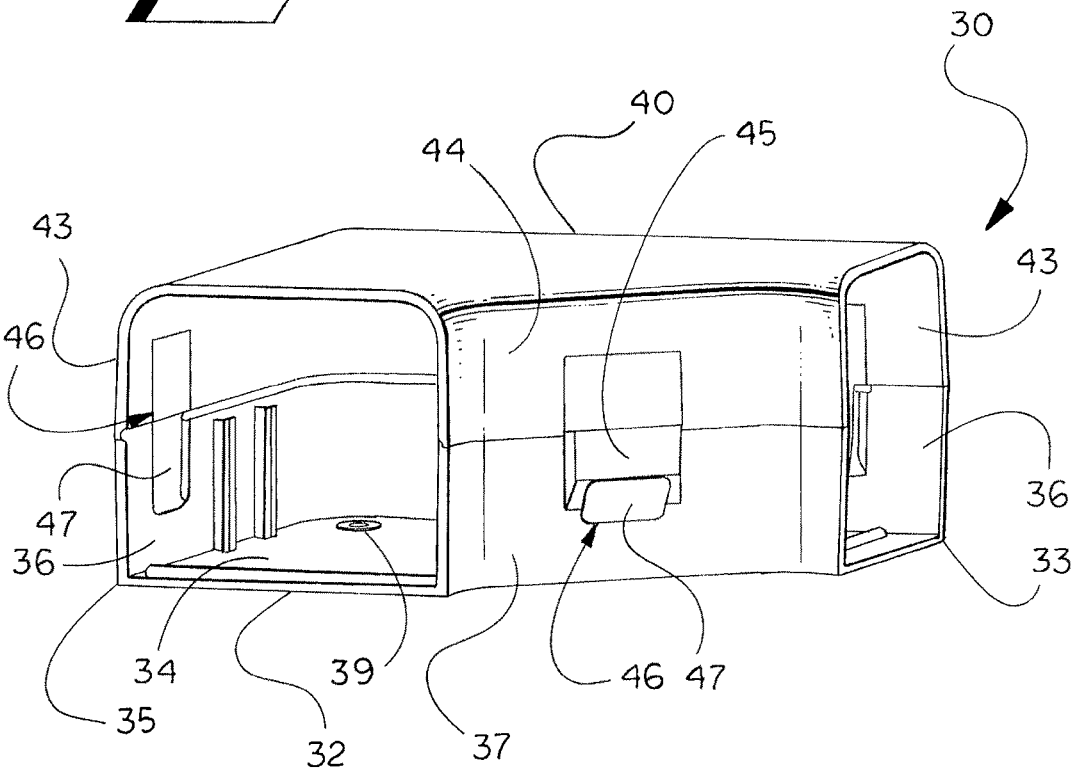
FIG. 4 is a side perspective view of the universal elbow in accordance with the present invention.

FIGS. 3 and 4 show the universal elbow 30 with the elbow cover 40 releasably connected to the elbow base 32 by means of the latches 46. The elbow base 32 comprises the bottom wall 34, right angle side walls 36, and 45° angle side wall 37. Latch keepers 45 formed in each of the right angle side walls 36 and 45° angle side wall 37 of the elbow base 32 comprise one part of each of the latches 46. The elbow cover 40 comprises a top wall 42, right angle side walls 43, and 45° angle side wall 44. Latch tabs 47 extending from the right angle side walls 43 and 45° angle sidewall 44 of the elbow cover 40 comprise the other part of each of the latches 46. The elbow base 32 also has screw openings 39 for mounting the elbow base 32 to the room wall 26 (FIGS. 1 and 2).

Figure 5:
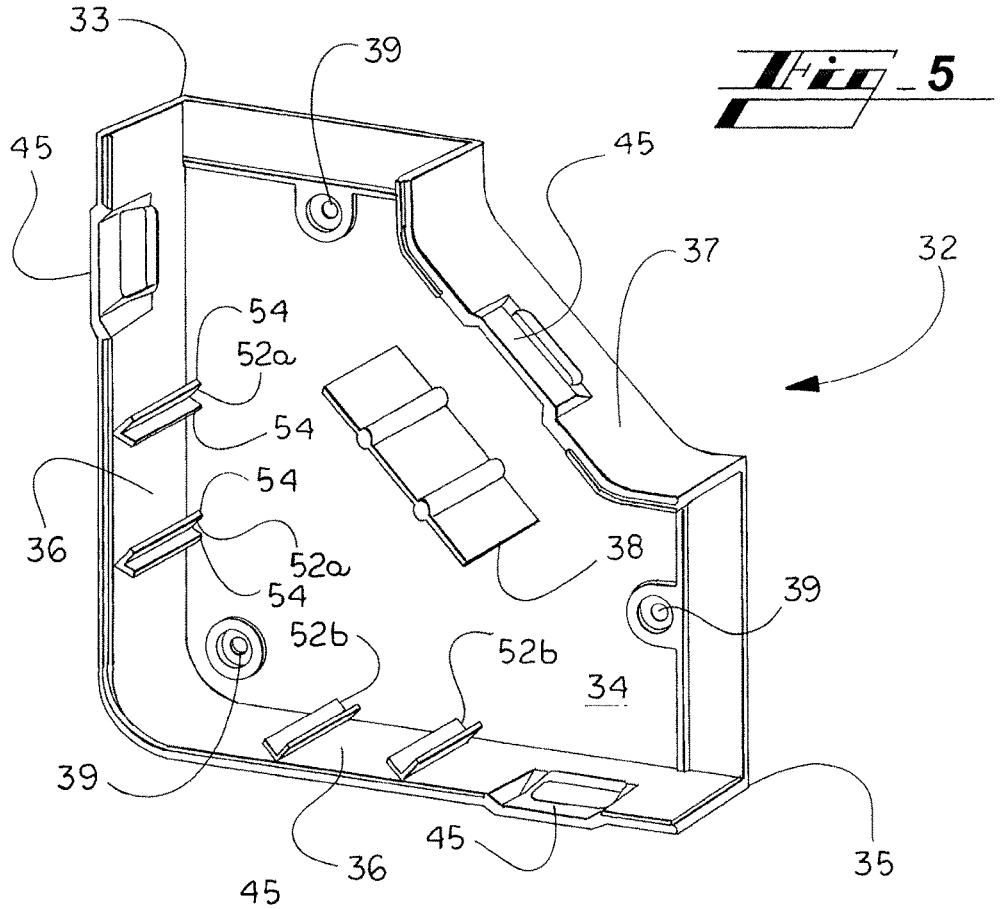
FIG. 5 is a side perspective view of the elbow base of the universal elbow in accordance with the present invention.
Figure 6:
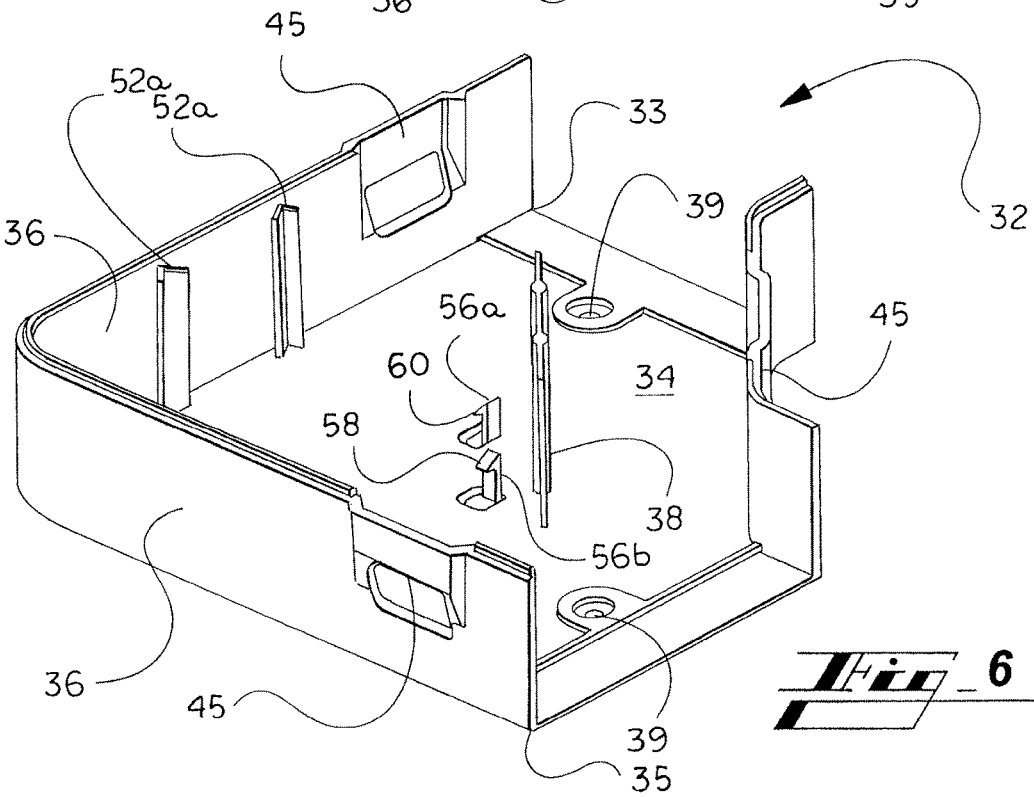
FIG. 6 is a side perspective view of the elbow base of the universal elbow in accordance with the present invention.
Figure 7:
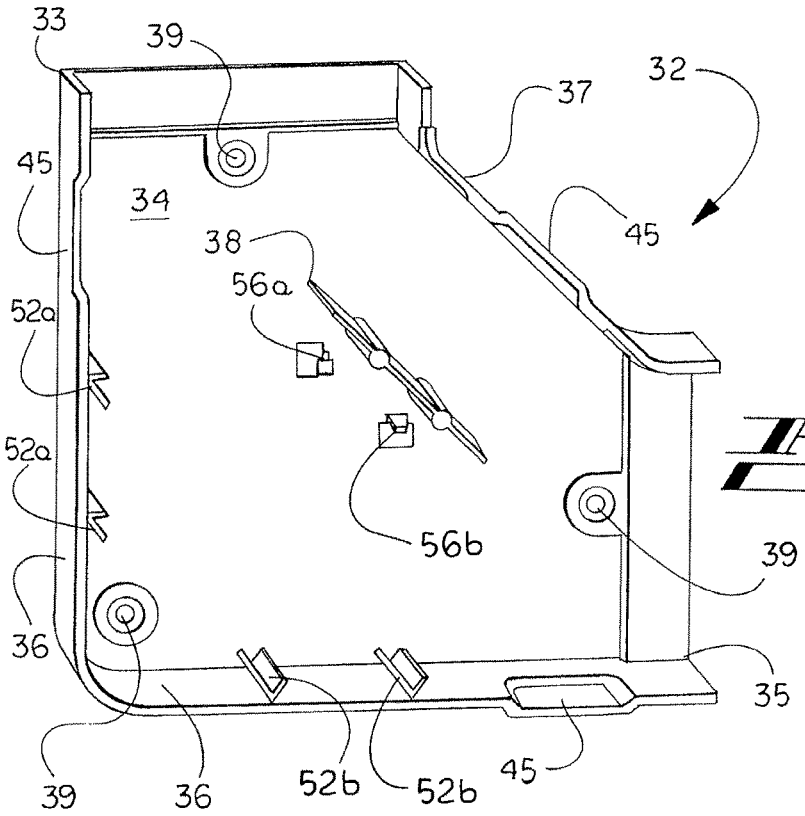
FIG. 7 is a side perspective view of the elbow base of the universal elbow in accordance with the present invention.

FIGS. 5-7 show the interior of the elbow base 32. A separator 38 extends from the bottom wall 34 of the elbow base 32. As shown in FIG. 2, the separator 38 retains the refrigeration lines 12*a* and 12*b* along the 45° angle side wall 37 of the elbow base 32 and the 45° angle side wall 44 of the elbow cover 40, thereby keeping the refrigeration lines 12*a* and 12*b* from interfering with the room left for the condensate tank 14 inside the universal elbow 30. With reference to FIG. 7, the elbow base 32 also includes an elbow base/clip securing structure comprising elbow base hooks 56*a* and 56*b* and elongated tracks 52*a* and 52*b* that hold the interface clip 48 in place within the elbow base 32. Each of the elbow base hooks 56*a* and 56*b* has a camming surface 58 and a retaining surface 60 (FIG. 6). Each elongated track 52*a* and 52*b* has track shoulders 54 (FIG. 5).

Figure 8:
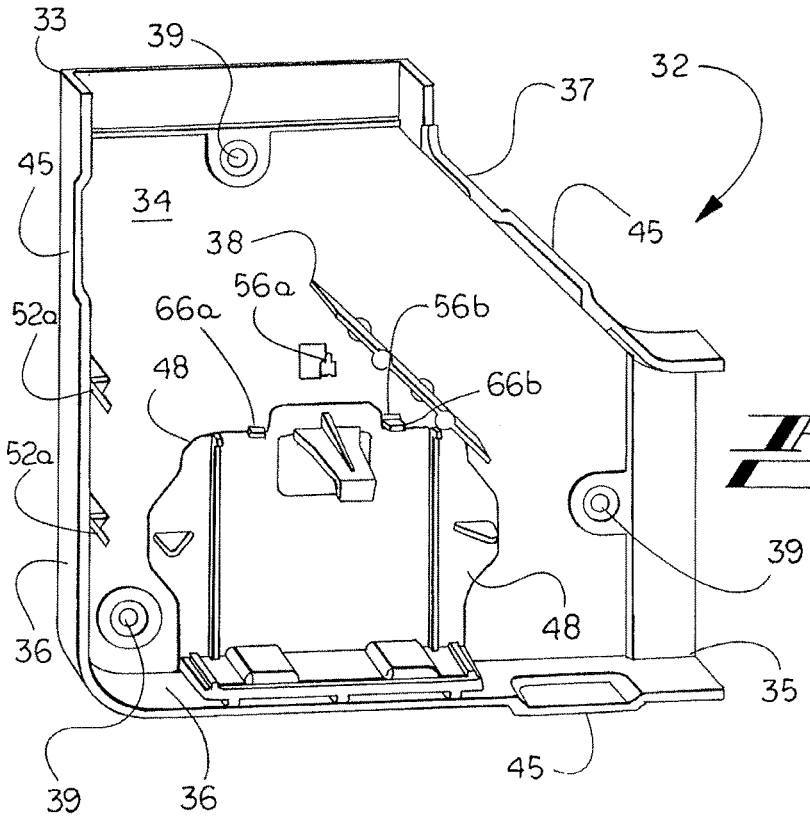
FIG. 8 is a side perspective view of the elbow base of the universal elbow with an attached interface clip in accordance with the present invention.
Figure 11:
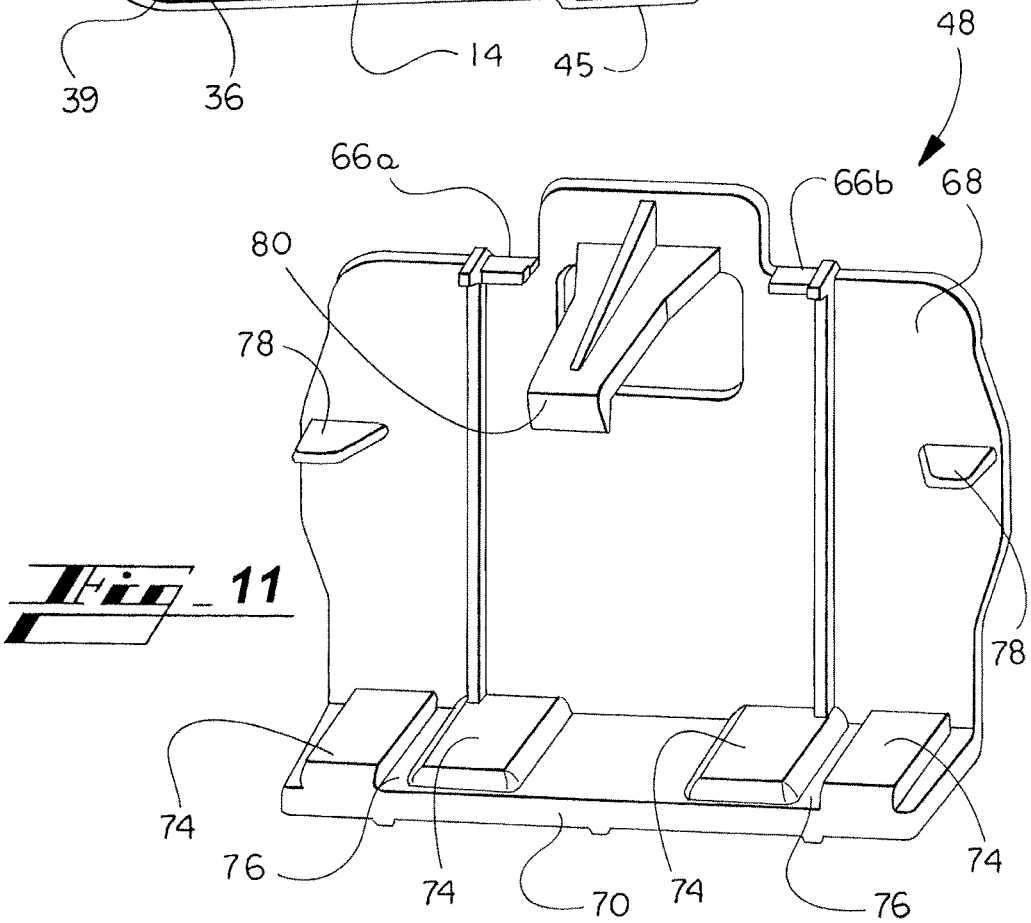
FIG. 11 is a front perspective view of a first embodiment of the interface clip in accordance with the present invention.
Figure 12:
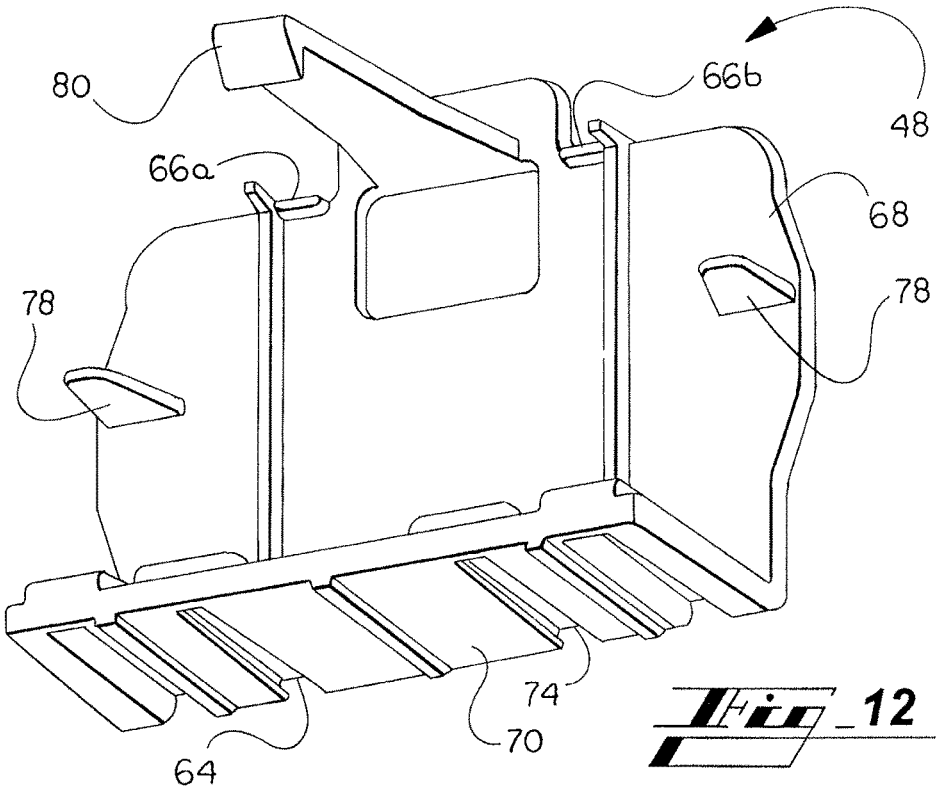
FIG. 12 is a bottom perspective view of the first embodiment of the interface clip in accordance with the present invention.
Figure 13:
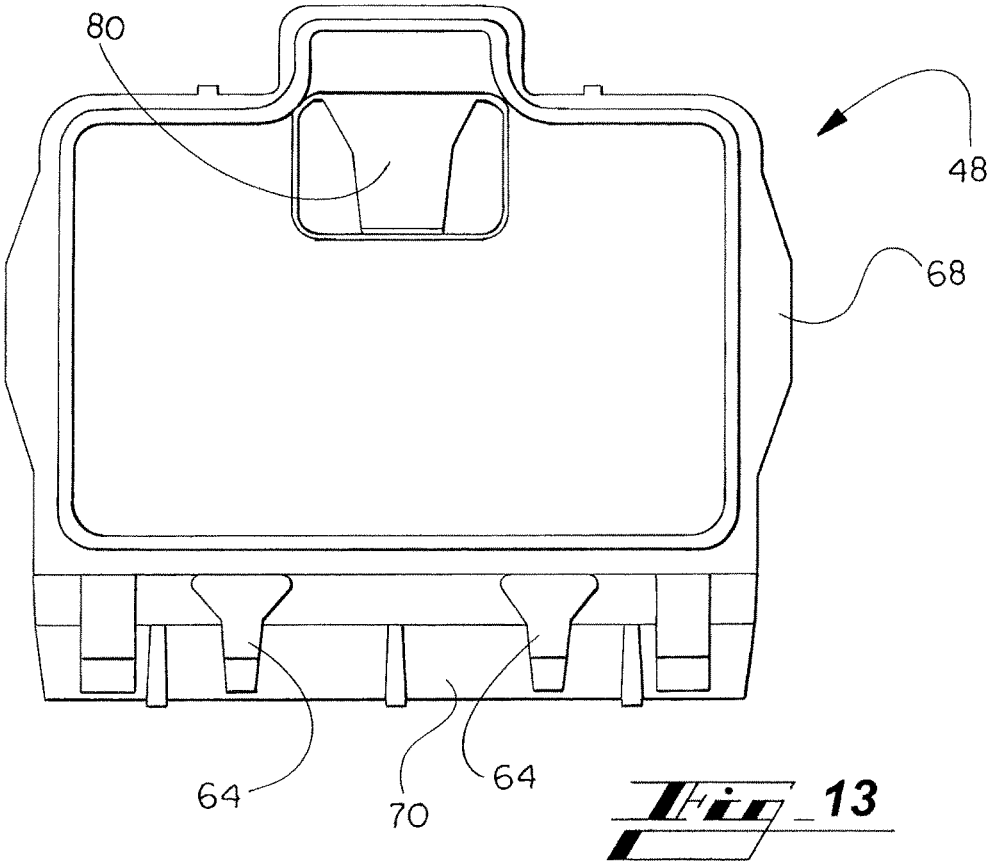
FIG. 13 is a back perspective view of the first embodiment of the interface clip in accordance with the present invention.

FIG. 8 shows interface clip 48 (see detail in FIGS. 11-13) releasably connected to the elbow base 32. As shown in FIGS. 12 and 13, the interface clip 48 has a clip/elbow base securing structure comprising two elongated grooves 64 that slidably engage the track shoulders 54 of the elongated tracks 52*a* or the elongated tracks 52*b*. The interface clip 48 also has clip shoulders 66*a* and 66*b* (FIGS. 11 and 12) that match the locations of elbow base hooks 56*a* and 56*b* respectively.

With continuing reference to FIG. 8, the interface clip 48 is mounted to the elbow base 32, by aligning the elongated grooves 64 of the interface clip 48 with the elongated tracks 52*b* and pushing the interface clip 48 toward the bottom wall 34 of the elbow base 32 along the elongated tracks 52*b*. Upon reaching the elbow hook 56*b*, the clip shoulder 66*b* engages the hook camming surface 58. Further movement of the interface clip 48 toward the bottom wall 34 of the elbow base 32 causes clip shoulder 66*b* to engage the camming surface 58 and deflect the base hook 56*b* thereby allowing the clip shoulder 66*b* to pass the base hook 56*b* and to seat against the bottom wall 34 and behind the hook retaining surface 60 (FIG. 6) of the base hook 56*b*. The combination of the elongated tracks 52*b* and the base hook 56*b* holds the interface clip 48 in place. The interface clip 48 can be removed by manually deflecting the base hook 56*b* to disengage the clip shoulder 66*b*, thereby allowing the interface clip 48 to move away from the bottom wall 34 of the elbow base 32 and out of engagement with the elongated tracks 52*b*.

With continuing reference to FIG. 8, the interface clip 48 can be rotated clockwise 90° so that the elongated grooves 64 of the interface clip 48 engages the other set of elongated tracks 52*a* and so that the clip shoulder 66*a* of the interface clip 48 engages the base hook 56*a*. As a result, the universal elbow 30 can be utilized as either a left or right turn elbow.

Figure 9:
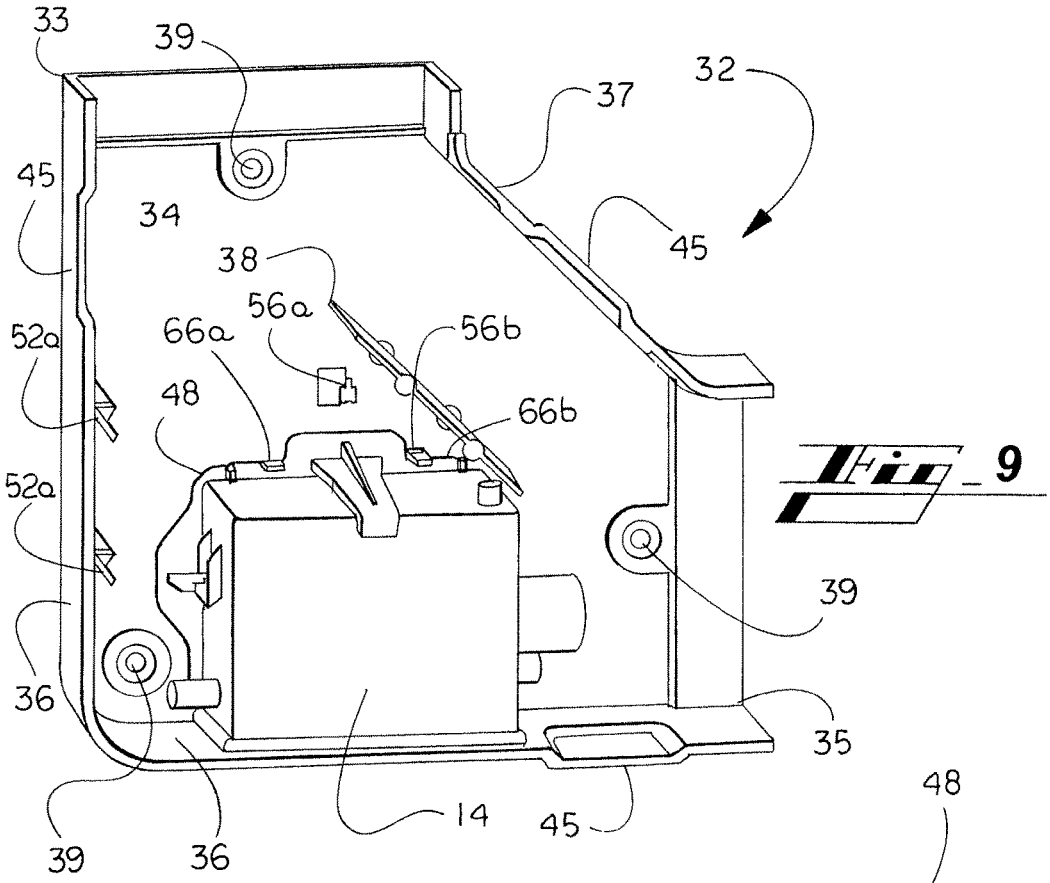
FIG. 9 is a side perspective view of the elbow base of the universal elbow with a condensate tank secured by the interface clip in accordance with the present invention.

FIG. 9 shows the condensate tank 14 releasably connected to the elbow base 32 by means of the interface clip 48. With reference to FIG. 11, the interface clip 48 comprises a clip backbone 68 and a clip base 70 set at right angles to each other. The interface clip 48 further includes a clip/tank securing structure comprising tank support pads 74, tank alignment grooves 76, lateral tank guides 78, and a tank hook 80. The interface clip 48 is specifically designed for the DiversiTech Clearview mini condensate tank. Particularly, the spacing and width of the tank alignment grooves 76 are configured to coincide with the bottom surface of the DiversiTech Clearview mini condensate tank. Likewise, the lateral tank guides 78 are configured to match the side walls of the DiversiTech Clearview mini condensate tank. The tank hook 80 is configured to span the width of the DiversiTech Clearview mini condensate tank and engage the top of the outer wall to secure the DiversiTech Clearview mini condensate tank in place.

Figure 14:
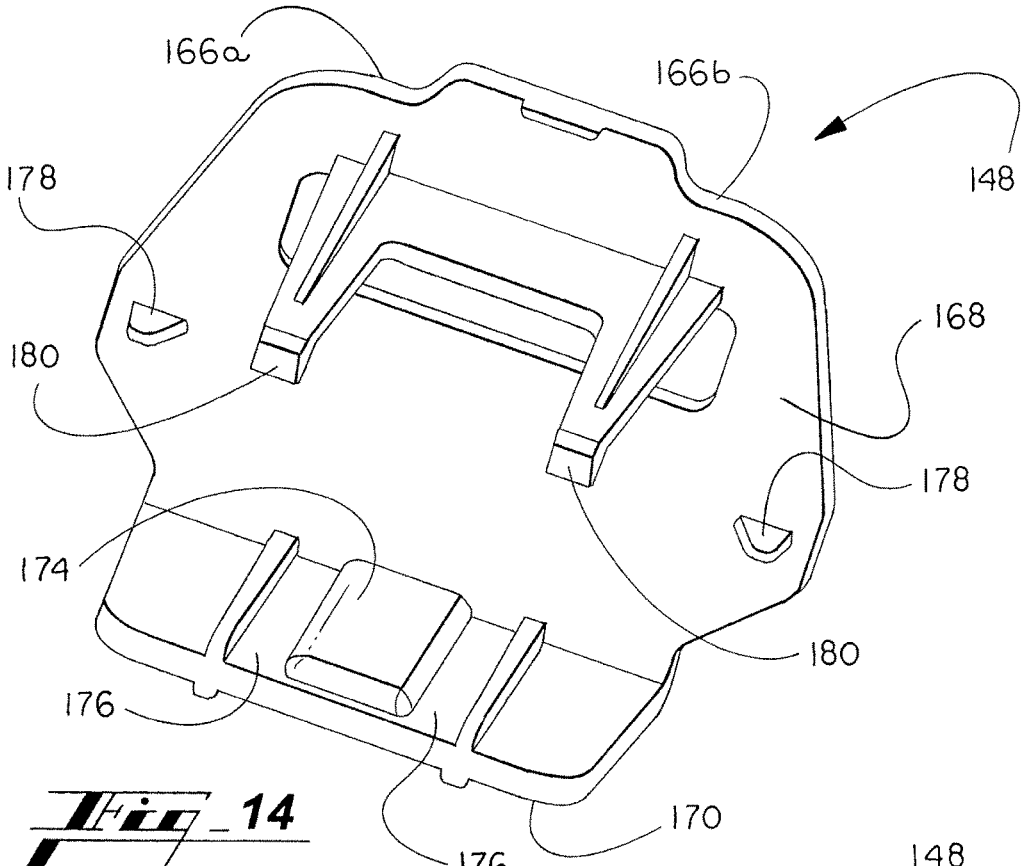
FIG. 14 is a front perspective view of a second embodiment of the interface clip in accordance with the present invention.
Figure 15:
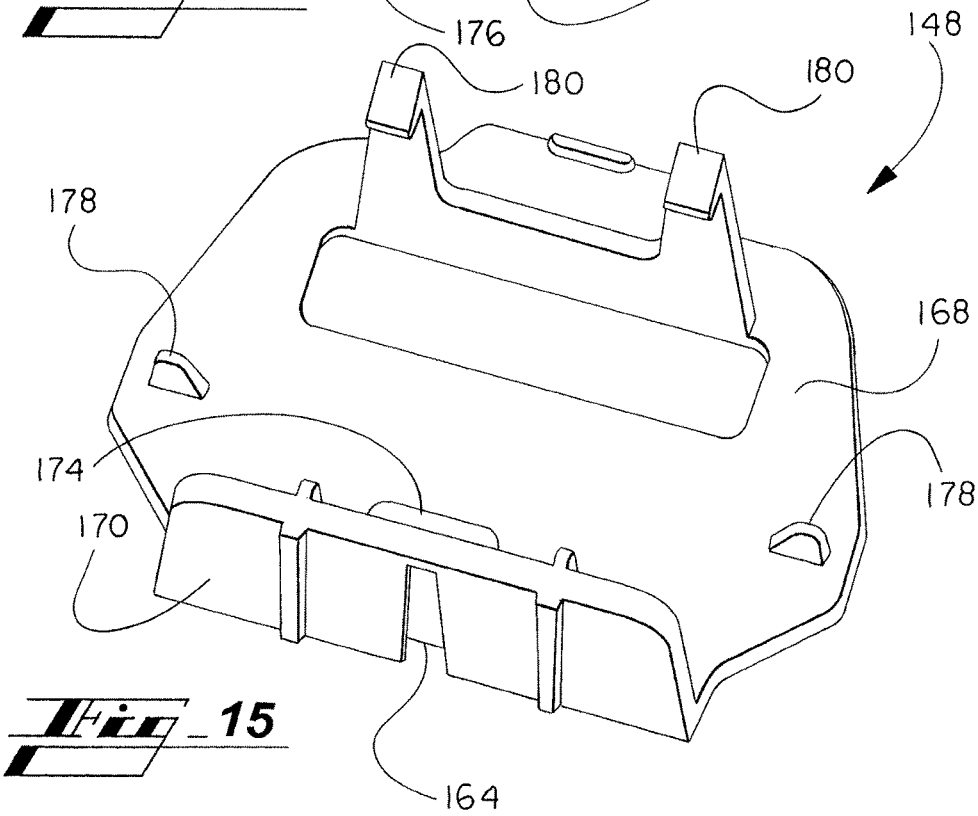
FIG. 15 is a bottom perspective view of the second embodiment of the interface clip in accordance with the present invention.

FIGS. 14-15 show interface clip 148 that can be releasably connected to the elbow base 32. The interface clip 148 comprises a clip backbone 168 and a clip base 170 set at right angles to each other. The clip backbone 168 and the clip base 170 of the interface clip 148 include a clip/elbow base securing structure comprising one elongated groove 164 in the clip base 170 that slidably engages the track shoulders 54 of one of the elongated tracks 52*a* or one of the elongated tracks 52*b*. The interface clip 148 also has clip shoulders 66*a* and 66*b* that match the locations of elbow base hooks 56*a* and 56*b* respectively.

The interface clip 148 is mounted to the elbow base 32, by aligning the elongated groove 164 of the interface clip 148 with one of the elongated tracks 52*b* and pushing the interface clip 148 toward the bottom wall 34 of the elbow base 32 along the elongated track 52*b*. Upon reaching the elbow base hook 56*b*, the clip shoulder 166*b* engages the hook camming surface 58 of the elbow hook 56*b*. Further movement of the interface clip 148 toward the bottom wall 34 of the elbow base 32 causes clip shoulder 166*b* to engage the camming surface 58 and deflect the elbow base hook 56*b* to allow the clip shoulder 166*b* to seat against the bottom wall 34 and behind the hook retaining surface 60 of the base hook 56*b*. The combination of the elongated tracks 52*b* and the base hook 56*b* holds the interface clip 48 in place. The interface clip 148 can be removed by manually deflecting the base hook 56*b* to disengage the clip shoulder 166*b* thereby allowing the interface clip 148 to move away from the bottom wall 34 of the elbow base 32 and out of engagement with the elongated track 52*b*.

Like the interface clip 48 shown in FIG. 8, the interface clip 148 can be rotated clockwise 90° within the elbow base 32 and thereby releasably engage one of the other set of elongated tracks 52*a* with the elongated groove 164 of the interface clip 148 and engage the base hook 56*a* with the clip shoulder 166*a*. As a result, the universal elbow 30 with the interface clip 148 can be utilized as either a left or right turn elbow.

The interface clip 148 releasably connects the condensate tank 14 to the elbow base. The interface clip 148 further includes a clip/tank securing structure comprising tank a support pad 174, tank alignment grooves 176, lateral tank guides 178, and tank hooks 180. The interface clip 148 is specifically designed for the Aspen Mini-Orange condensate tank and pump, the Aspen maxi-orange condensate tank and pump, and Aspen Mini-Aqua condensate tank and pump. Particularly, the spacing and width of the tank alignment grooves 176 are configured to coincide with the bottom surface of the Aspen pumps. Likewise, the lateral tank guides 178 are configured to match the side walls of the Aspen pumps. The tank hook 180 is configured to span the width of the Aspen pumps and engage the top of the outer wall to secure the Aspen pumps in place.

Figure 16:
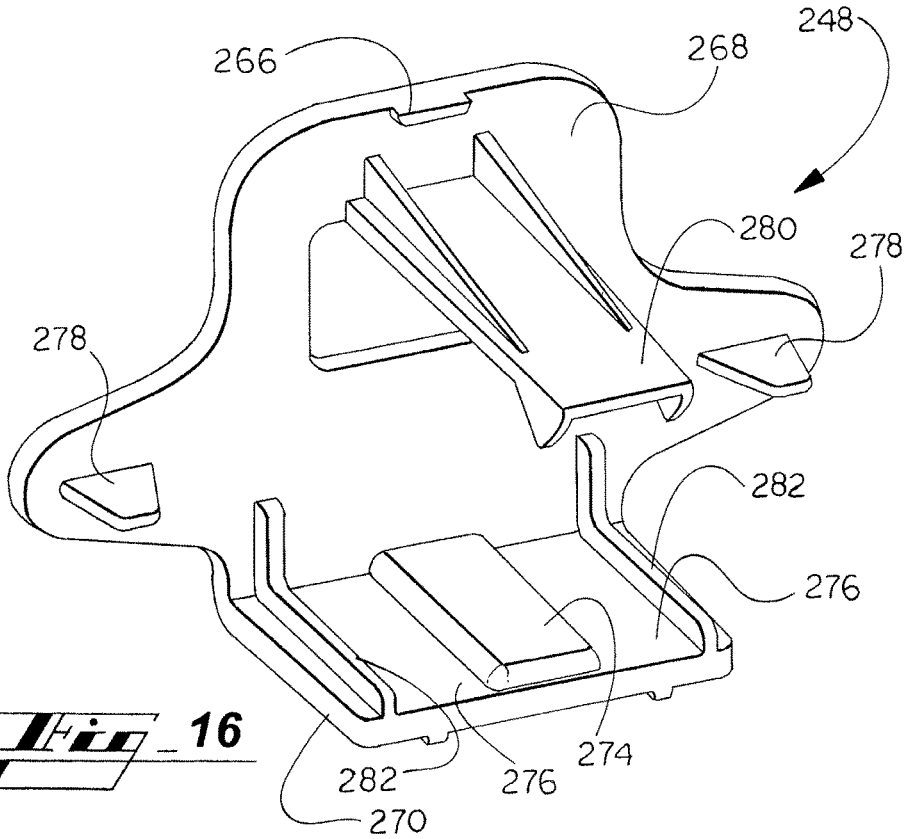
FIG. 16 is a front perspective view of a third embodiment of the interface clip in accordance with the present invention.
Figure 17:
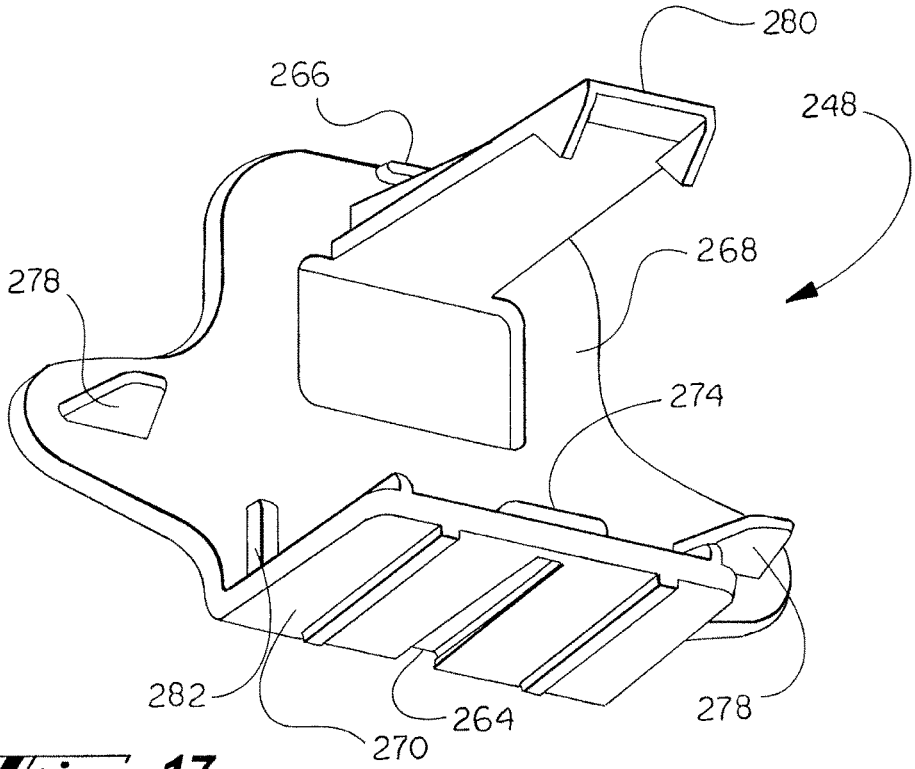
FIG. 17 is a bottom perspective view of the third embodiment of the interface clip in accordance with the present invention.

FIGS. 16-17 show interface clip 248 that can be releasably connected to the elbow base 32. The interface clip 248 comprises a clip backbone 268 and a clip base 270 connected together at substantially a right angle. The clip backbone 268 and the clip base 270 of the interface clip 248 include a clip/elbow base securing structure comprising one elongated groove 264 in the clip base 270 that slidably engage the track shoulders 54 of one of the elongated tracks 52*a* or one of the elongated tracks 52*b*. The interface clip 248 also has a clip shoulder 266 that matches the locations of elbow base hooks 56*a* or 56*b*.

The interface clip 248 is mounted to the elbow base 32, by aligning the elongated groove 264 of the interface clip 248 with one of the elongated tracks 52*b* and pushing the interface clip 248 toward the bottom wall 34 of the elbow base 32 along the elongated track 52*b*. Upon reaching the elbow hook 56*b*, the clip shoulder 266 engages the hook camming surface 58 of the elbow hook 56*b*. Further movement of the interface clip 248 toward the bottom wall 34 of the elbow base 32 causes clip shoulder 266 to engage the camming surface 58 and deflect the base hook 56*b* to allow the clip shoulder 266 to seat against the bottom wall 34 and behind the hook retaining surface 60 of the base hook 56*b*. The combination of the elongated tracks 52*b* and the base hook 56*b* holds the interface clip 48 in place. The interface clip 248 can be removed by manually deflecting the base hook 56*b* to disengage the clip shoulder 266 thereby allowing the interface clip 248 to move away from the bottom wall 34 of the elbow base 32 and out of engagement with the elongated track 52*b*.

Like the interface clip 48 shown in FIG. 8, the interface clip 248 can be rotated clockwise 90° within the elbow base 32 and thereby releasably engage one of the other set of the elongated tracks 52*a* with the elongated groove 264 of the interface clip 248 and engage the base hook 56*a* with the clip shoulder 266. As a result, the universal elbow 30 with the interface clip 248 can be utilized as either a left or right turn elbow.

The interface clip 248 releasably connects condensate tank 14 to the elbow base 32. The interface clip 248 further includes a clip/tank securing structure comprising tank a support pad 274, tank alignment grooves 276, lateral tank guides 278, a tank hook 280, and bottom guides 282. The interface clip 248 is specifically designed for the Little Giant EC-1 condensate tank. Particularly, the spacing and width of the tank alignment grooves 276 and the bottom guides 282 are configured to coincide with the bottom surface of the Little Giant EC-1 condensate tank. Likewise, the lateral tank guides 278 are configured to match the side walls of the Little Giant EC-1 condensate tank. The tank hook 280 is configured to span the width of the Little Giant EC-1 condensate tank and engage the top of the outer wall to secure the Little Giant EC-1 condensate tank in place.

Figure 18:
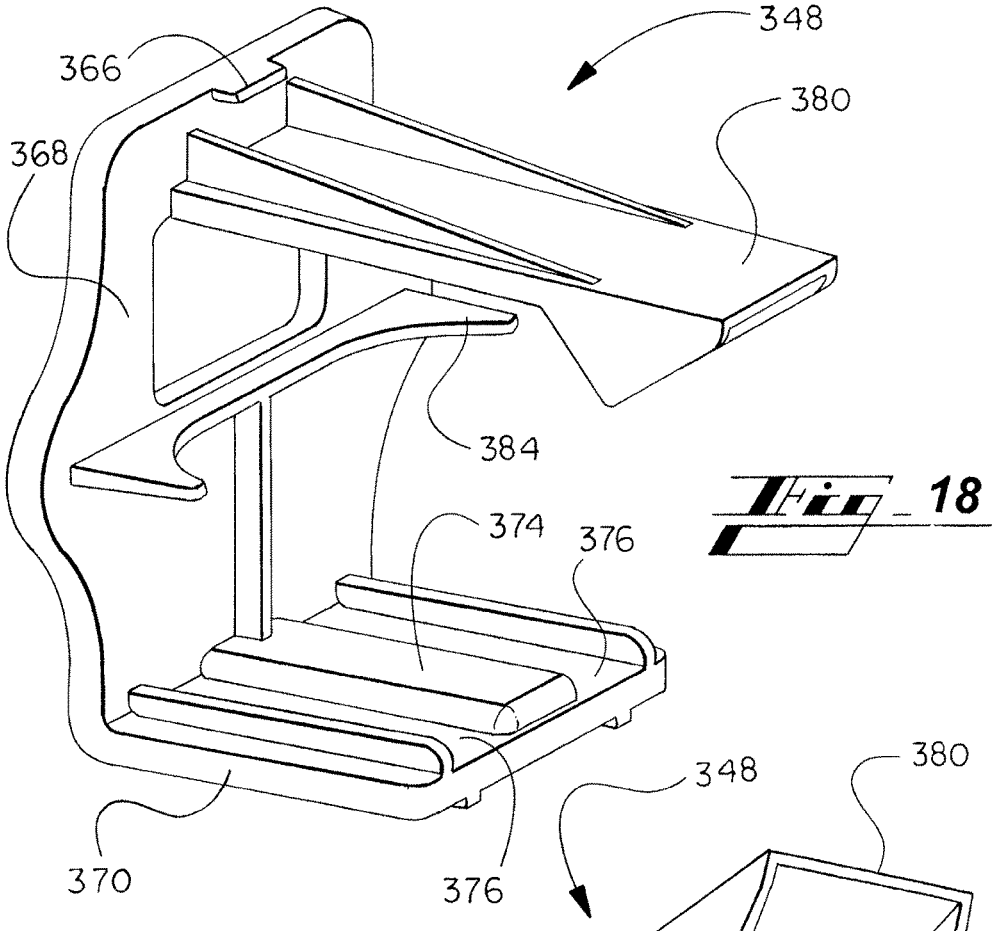
FIG. 18 is a front perspective view of a fourth embodiment of the interface clip in accordance with the present invention.
Figure 19:
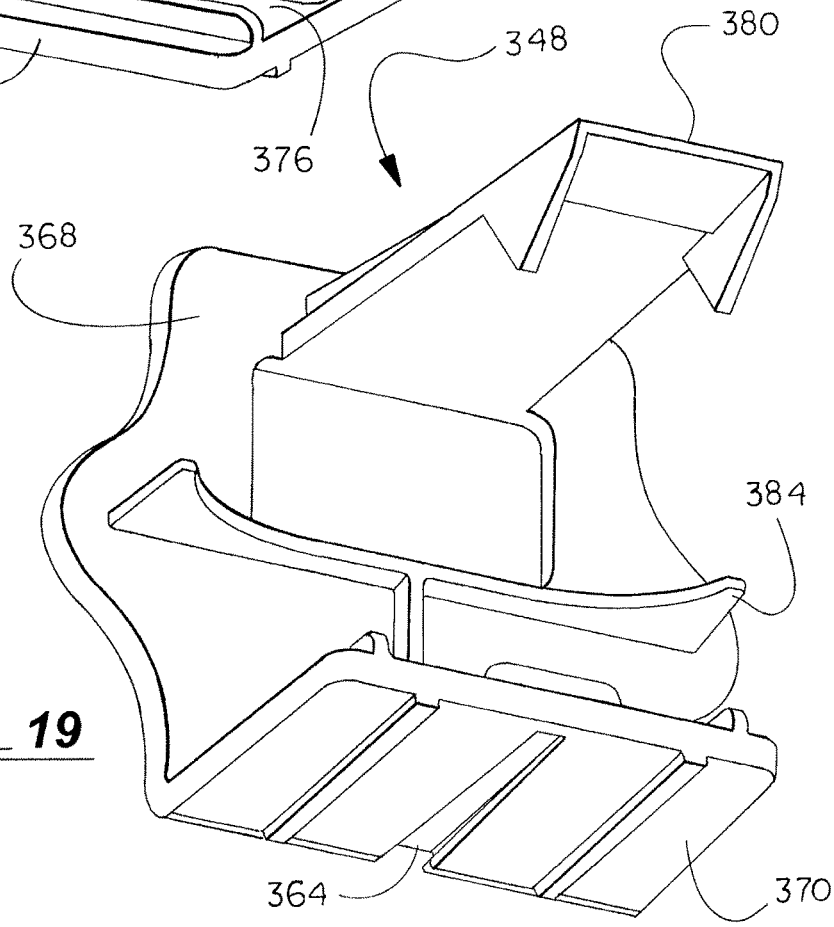
FIG. 19 is a bottom perspective view of the fourth embodiment of the interface clip in accordance with the present invention.

FIGS. 18-19 show interface clip 348 that can be releasably connected to the elbow base 32. The interface clip 348 comprises a clip backbone 368 and a clip base 370 connected together at substantially a right angle. The clip backbone 368 and the clip base 370 of the interface clip 348 include a clip/elbow base securing structure comprising one elongated groove 364 in the clip base 370 that slidably engages the track shoulders 54 of one of the elongated tracks 52*a* or one of the elongated tracks 52*b*. The interface clip 348 also has a clip shoulder 366 that matches the locations of elbow base hooks 56*a* or 56*b*.

The interface clip 348 is mounted to the elbow base 32, by aligning the elongated groove 364 of the interface clip 348 with one of the elongated tracks 52*b* and pushing the interface clip 348 toward the bottom wall 34 of the elbow base 32 along the elongated track 52*b*. Upon reaching the elbow hook 56*b*, the clip shoulder 366 engages the hook camming surface 58 of the elbow hook 56*b*. Further movement of the interface clip 348 toward the bottom wall 34 of the elbow base 32 causes clip shoulder 366 to engage the camming surface 58 and deflect the base hook 56*b* to allow the clip shoulder 366 to seat against the bottom wall 34 and behind the hook retaining surface 60 of the elbow base hook 56*b*, thereby retaining the interface clip 348 in place. The interface clip 348 can be removed by manually deflecting the elbow base hook 56*b* to disengage the clip shoulder 366 thereby allowing the interface clip 348 to move away from the bottom wall 34 of the elbow base 32 and out of engagement with the elongated track 52*b*.

Like the interface clip 48 shown in FIG. 8, the interface clip 348 can be rotated clockwise 90° within the elbow base 32 and thereby releasably engage one of the other set of the elongated tracks 52*a* with the elongated groove 364 of the interface clip 348 and engage the base hook 56*a* with the clip shoulder 366. As a result, the universal elbow 30 with the interface clip 348 can be utilized as either a left or right turn elbow.

The interface clip 348 releasably connects condensate tank 14 to the elbow base 32. The interface clip 348 further includes a clip/tank securing structure comprising tank a support pad 374, tank alignment grooves 376, back standoff 384, and a tank hook 380. The interface clip 348 is specifically designed for the Little Giant EC-400 condensate tank. Particularly, the spacing and width of the tank alignment grooves 376 are configured to coincide with the bottom surface of the Little Giant EC-400 condensate tank. Likewise, the back standoff 384 is configured to match the side walls of the Little Giant EC-400 condensate tank. The tank hook 380 is configured to span the width of the Little Giant EC-400 condensate tank and engage the top of the outer wall to secure the Little Giant EC-400 condensate tank in place.

Figure 20:
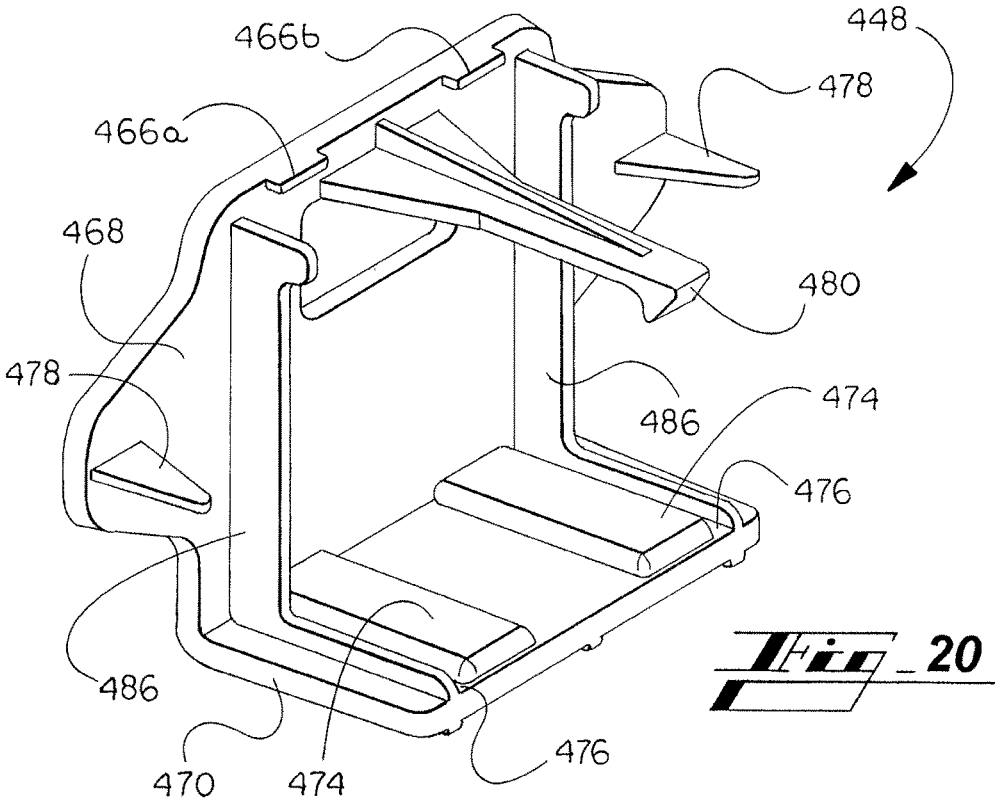
FIG. 20 is a front perspective view of a fifth embodiment of the interface clip in accordance with the present invention.
Figure 21:
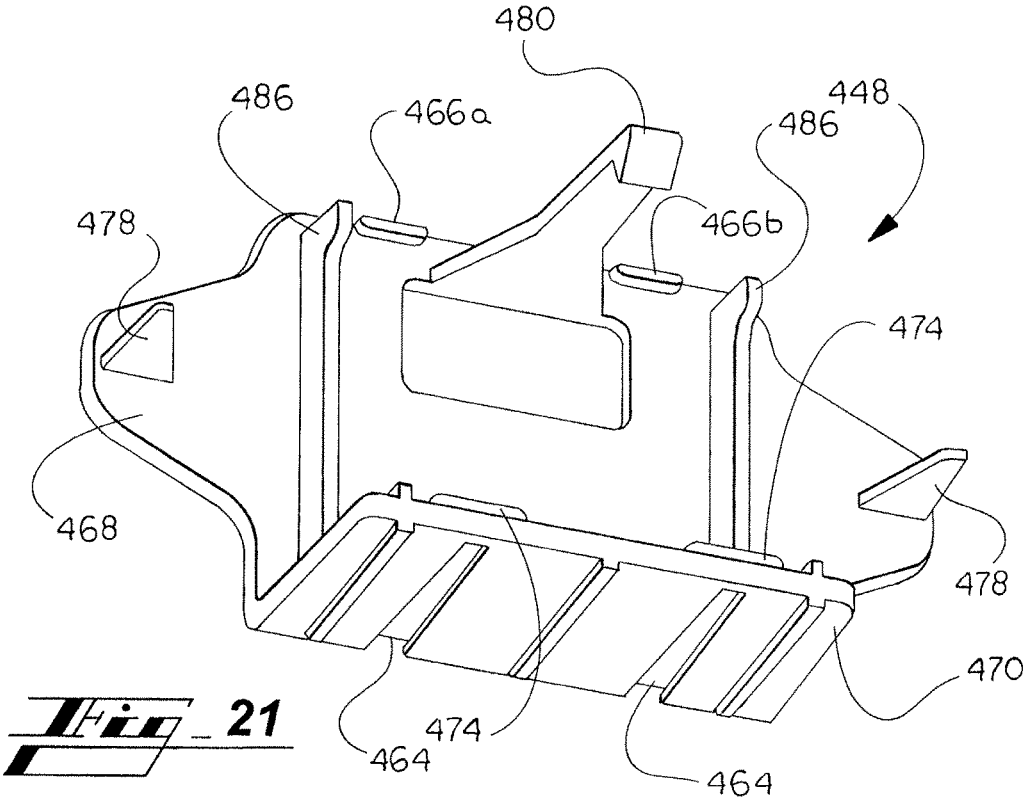
FIG. 21 is a bottom perspective view of the fifth embodiment of the interface clip in accordance with the present invention.

FIGS. 20-21 show interface clip 448 that can be releasably connected to the elbow base 32. The interface clip 448 comprises a clip backbone 468 and a clip base 470 connected together at substantially a right angle. The clip backbone 468 and the clip base 470 of the interface clip 448 include a clip/elbow base securing structure comprising two elongated grooves 464 in the clip base 470 that slidably engage the track shoulders 54 of the elongated tracks 52*a* or the elongated tracks 52*b*. The interface clip 448 also has clip shoulders 466*a* and 466*b* that match the locations of elbow base hooks 56*a* or 56*b*.

The interface clip 448 is mounted to the elbow base 32, by aligning the elongated grooves 464 of the interface clip 448 with the elongated tracks 52*b* and pushing the interface clip 448 toward the bottom wall 34 of the elbow base 32 along the elongated tracks 52*b*. Upon reaching the elbow hook 56*b*, the clip shoulder 466*b* engages the hook camming surface 58 of the elbow hook 56*b*. Further movement of the interface clip 448 toward the bottom wall 34 of the elbow base 32 causes clip shoulder 466*b* to engage the camming surface 58 and deflect the base hook 56*b* to allow the clip shoulder 466*b* to seat against the bottom wall 34 and behind the hook retaining surface 60 of the base hook 56*b*. The combination of the elongated tracks 52*b* and the base hook 56*b* holds the interface clip 48 in place. The interface clip 448 can be removed by manually deflecting the base hook 56*b* to disengage the clip shoulder 466*b* thereby allowing the interface clip 448 to move away from the bottom wall 34 of the elbow base 32 and out of engagement with the elongated tracks 52*b*.

Like the interface clip 48 shown in FIG. 8, the interface clip 448 can be rotated clockwise 90° within the elbow base 32 and thereby releasably engage the other set of the elongated tracks 52*a* with the elongated grooves 464 of the interface clip 448 and engage the base hook 56*a* with the clip shoulder 466*a*. As a result, the universal elbow 30 with the interface clip 448 can be utilized as either a left or right turn elbow.

The interface clip 448 releasably connects condensate tank to the elbow base 32. The interface clip 448 further includes a clip/tank securing structure comprising tank support pads 474, tank alignment grooves 476, tank guides 478, side tank guides 486, and a tank hook 480. The interface clip 448 is specifically designed for the MaxiBlue condensate tank. Particularly, the spacing and width of the tank alignment grooves 476 are configured to coincide with the bottom surface of the MaxiBlue condensate tank. Likewise, the side tank guides 486 are configured to match the back wall of the MaxiBlue condensate tank. The tank hook 480 is configured to span the width of the MaxiBlue condensate tank and engage the top of the outer wall to secure the MaxiBlue condensate tank in place.

Figure 22:
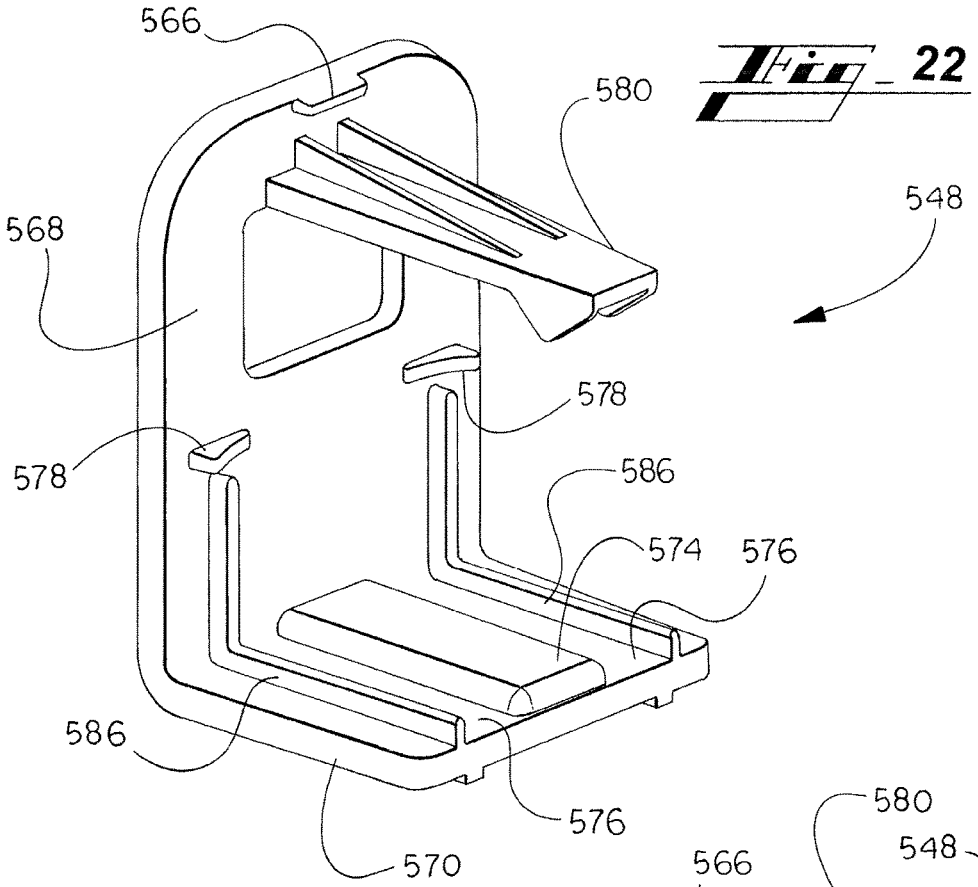
FIG. 22 is a front perspective view of a sixth embodiment of the interface clip in accordance with the present invention.
Figure 23:
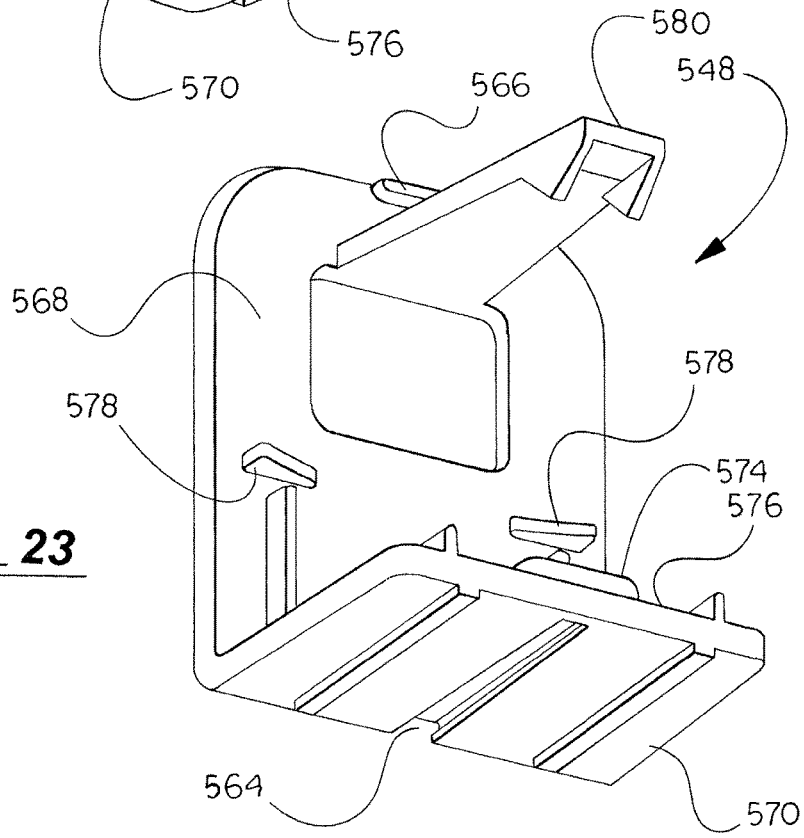
FIG. 23 is a bottom perspective view of the sixth embodiment of the interface clip in accordance with the present invention.

FIGS. 22-23 show interface clip 548 that can be releasably connected to the elbow base 32. The interface clip 548 comprises a clip backbone 568 and a clip base 570 connected together at substantially a right angle. The clip backbone 568 and the clip base 570 of the interface clip 548 include a clip/elbow base securing structure comprising one elongated groove 564 in the clip base 570 that slidably engage the track shoulders 54 of one of the elongated tracks 52*a* or one of the elongated tracks 52*b*. The interface clip 548 also has a clip shoulder 566 that matches the locations of elbow base hooks 56*a* or 56*b*.

The interface clip 548 is mounted to the elbow base 32, by aligning the elongated groove 564 of the interface clip 548 with one of the elongated tracks 52*b* and pushing the interface clip 548 toward the bottom wall 34 of the elbow base 32 along the elongated track 52*b*. Upon reaching the elbow hook 56*b*, the clip shoulder 566 engages the hook camming surface 58 of the elbow hook 56*b*. Further movement of the interface clip 548 toward the bottom wall 34 of the elbow base 32 causes clip shoulder 566 to engage the camming surface 58 and deflect the base hook 56*b* to allow the clip shoulder 566 to seat against the bottom wall 34 and behind the hook retaining surface 60 of the base hook 56*b*. The combination of the elongated tracks 52*b* and the base hook 56*b* holds the interface clip 48 in place. The interface clip 548 can be removed by manually deflecting the base hook 56*b* to disengage the clip shoulder 566 thereby allowing the interface clip 348 to move away from the bottom wall 34 of the elbow base 32 and out of engagement with the elongated track 52*b*.

Like the interface clip 48 shown in FIG. 8, the interface clip 548 can be rotated clockwise 90° within the elbow base 32 and thereby releasably engage one of the other set of the elongated tracks 52*a* with the elongated groove 564 of the interface clip 548 and engage the base hook 56*a* with the clip shoulder 566. As a result, the universal elbow 30 with the interface clip 348 can be utilized as either a left or right turn elbow.

The interface clip 548 releasably connects condensate tank to the elbow base 32. The interface clip 548 further includes a clip/tank securing structure comprising tank a support pad 574, tank alignment grooves 576, tank guides 578, side tank guides 586, and a tank hook 580. The interface clip 348 is specifically designed for the DiversiTech CP-M230 and MP-M115 condensate tanks, the Sauerman Si-20, Si-30 and Si-33 condensate tanks, and the Siccom mini FLOWATCH series condensate tanks. Particularly, the spacing and width of the tank alignment grooves 576 are configured to coincide with the bottom surface of the DiversiTech CP-M230 and MP-M115 condensate tanks, the Sauerman Si-20, Si-30 and Si-33 condensate tanks, and the Siccom mini FLOWATCH series condensate tanks. Likewise, the tank guides 578 and the side tank guides 586 are configured to match the side walls of the DiversiTech CP-M230 and MP-M115 condensate tanks, the Sauerman Si-20, Si-30 and Si-33 condensate tanks, and the Siccom mini FLOWATCH series condensate tanks. The tank hook 580 is configured to span the width of the DiversiTech CP-M230 and MP-M115 condensate tanks, the Sauerman Si-20, Si-30 and Si-33 condensate tanks, and the Siccom mini FLOWATCH series condensate tanks and engage the top of the outer wall to secure the DiversiTech CP-M230 and MP-M115 condensate tanks, the Sauerman Si-20, Si-30 and Si-33 condensate tanks, and the Siccom mini FLOWATCH series condensate tanks.

Figure 10:
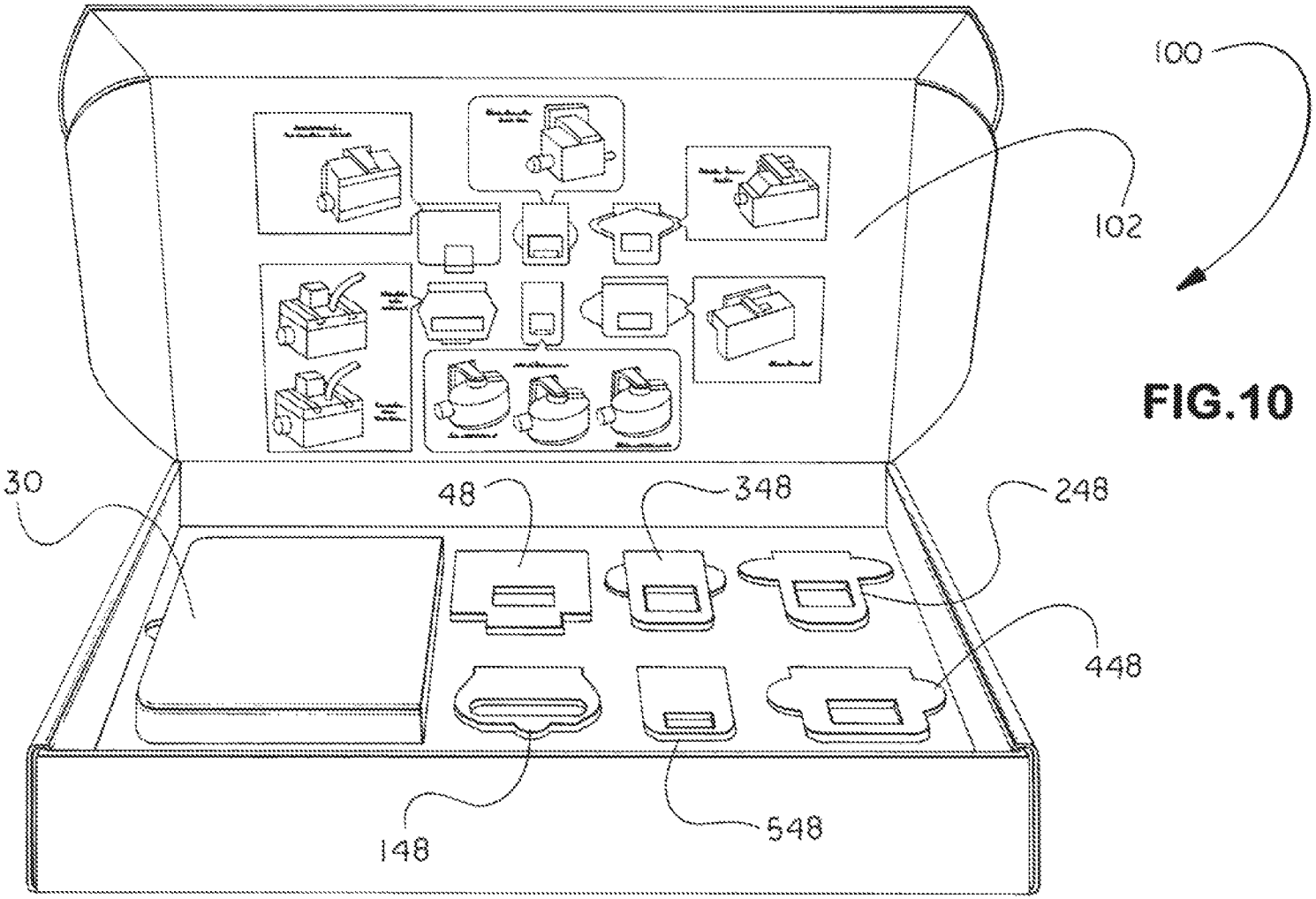
FIG. 10 is a front perspective view of a package including the universal elbow and six distinct interface clips in accordance with the present invention.

FIG. 10 shows a kit 100 for distributing the universal elbow 30 of the present invention to consumers, typically installers. Particularly, the kit 100 includes the universal elbow 30 and the six interface clips 48, 148, 248, 348, 448, and 548. The kit 100 also includes a chart 102 showing the layout of the six interface clips 48, 148, 248, 348, 448, and 548 in the kit and including descriptions and pictures 48A, 148A, 248A, 348A, 448A, and 548A for each of the condensate tanks that correlates with the particular interface clip required for that condensate tank.

While this invention has been described with reference to preferred embodiments thereof, it is to be understood that variations and modifications can be affected within the spirit and scope of the invention as described herein and as described in the appended claims.

I claim:

1. A universal line components elbow [30] for housing line components [16, 18, 20] and a condensate tank [14] comprising:

a. an elbow base [32] having an elbow base/clip securing structure [52, 54, 56, 58, 60];

b. an elbow cover [40] connected to the elbow base [32] for closing the universal line components elbow [30]; and c. an interface clip [48] comprising:

i. a clip/elbow securing structure [64, 66, 68, 70] on one side of the interface clip [48] for engaging the elbow base/clip securing structure [52, 54, 56, 58, 60] of the elbow base [32] in order to secure the interface clip [48] to the elbow base [32]; and ii. a clip/tank securing structure [74, 76, 78, 80, 282, 384, 486, etc.] on an opposite side of the interface clip [48] for engaging the condensate tank [14] in order to secure the condensate tank [14] to the interface clip [48] and therefore to the elbow base [32].

2. The universal line components elbow of claim 1, wherein the line components include refrigeration lines and wherein the elbow base has a bottom wall and side walls, wherein the elbow base includes a separator connected to and extending from the bottom wall essentially parallel to the side walls, and wherein the separator defines a space for the refrigeration lines and a space for the condensate tank.

3. The universal line components elbow of claim 1, wherein the elbow base has a bottom wall and side walls, wherein the elbow base/clip securing structure of the elbow base comprises a base hook extending from the bottom wall and essentially parallel to the sidewalls and an elongated track connected to and extending along one of the sidewalls essentially perpendicular to the bottom wall, wherein the clip/elbow securing structure of the interface clip includes at least one elongated groove for engaging the elongated track of the sidewall and a clip shoulder for engaging the base hook of the bottom wall, and wherein the clip/tank securing structure of the interface clip includes a tank support pad, tank guides, and a tank hook for securing the condensate tank to the interface clip and therefore to the elbow base.

4. The universal line components elbow of claim 3, wherein the base hook includes a camming surface that engages the clip shoulder so that movement of the clip shoulder toward the bottom wall deflects the base hook and thereby allows the clip shoulder to pass by the base hook and engage a hook retaining surface of the base hook.

5. The universal line components elbow of claim 3, wherein the tank support pad, the tank guides, and the tank hook of the clip/tank securing structure of the interface clip are positioned and dimensioned to conform to the size and dimensions of a particular condensate tank.

6. A universal line components elbow kit [100] comprising:

a. a universal line components elbow [30] comprising:

i. an elbow base [32] having an elbow base/clip securing structure [52, 54, 56, 58, 60];

ii. an elbow cover [40] connected to the elbow base [32] for closing the universal line components elbow [30]; and b. a plurality of interface clips [48, 148, 248, 348, 448, 548] each interface clip comprising:

i. a common clip/elbow securing structure [64, 66, 68, 70] on one side of the interface clip [48, 148, 248,

348, 448, 548] for engaging the elbow base/clip securing structure [52, 54, 56, 58, 60] of the elbow base [32] in order to secure the interface clip [48, 148, 248, 348, 448, 548] to the elbow base [32]; and ii. a unique clip/tank securing structure [74, 76, 78, 80, 282, 384, 486, etc.] on an opposite side of the interface clips [48, 148, 248, 348, 448, 548] for engaging one of a plurality of condensate tanks [14 in order to secure a condensate tank to the interface clips [48, 148, 248, 348, 448, 548] and therefore to the elbow base [32].

7. The universal line components elbow of claim 6, wherein the line components include refrigeration lines and wherein the elbow base has a bottom wall and side walls, wherein the elbow base includes a separator connected to and extending from the bottom wall essentially parallel to the side walls, and wherein the separator defines a space for the refrigeration lines and a space for the condensate tank.

8. The universal line components elbow of claim 6, wherein the elbow base has a bottom wall and side walls, wherein the elbow base/clip securing structure of the elbow base comprises a base hook extending from the bottom wall and essentially parallel to the sidewalls and an elongated track connected to and extending along one of the sidewalls essentially perpendicular to the bottom wall, wherein the clip/elbow securing structure of the interface clip includes at least one elongated groove for engaging the elongated track of the sidewall and a clip shoulder for engaging the base hook of the bottom wall, and wherein the clip/tank securing structure of the interface clip includes a tank support pad, tank guides, and a tank hook for securing a condensate tank to the interface clip and therefore to the elbow base.

9. The universal line components elbow of claim 8, wherein the base hook includes a camming surface that engages the clip shoulder so that movement of the clip shoulder toward the bottom wall deflects the base hook and thereby allows the clip shoulder to pass by the base hook and engage a hook retaining surface of the base hook.

10. The universal line components elbow of claim 8, wherein the tank support pad, the tank guides, and the tank hook of the clip/tank securing structure of the interface clip are positioned and dimensioned to conform to the size and dimensions of a particular condensate tank.

* * * * *